US005742960A

United States Patent [19]

Shamir

[11] Patent Number: 5,742,960

[45] Date of Patent: Apr. 28, 1998

[54] ROCKABLE CRIB AND SUPPORT THEREFOR

[76] Inventor: Yoav Shamir, Yekutiel Adam Street 60/1, Beit Shemesh, Israel, 99000

[21] Appl. No.: 731,434

[22] Filed: Oct. 15, 1996

[51] Int. Cl.[6] ..... A47D 9/04

[52] U.S. Cl. ..... 5/107; 248/143; 5/108

[58] Field of Search ..... 5/107, 108, 109, 5/105; 297/273; 248/143

[56] References Cited

U.S. PATENT DOCUMENTS

| | | | |
|---|---|---|---|
| 3,802,003 | 4/1974 | Laureti | 5/108 |
| 4,419,777 | 12/1983 | Parker | 5/108 |
| 4,793,009 | 12/1988 | Degen | 5/108 |
| 4,793,010 | 12/1988 | Gross et al. | 5/105 |
| 4,837,876 | 6/1989 | Levy | 5/107 |
| 5,123,701 | 6/1992 | Bottamiller et al. | 5/108 |

*Primary Examiner*—Alexander Grosz
*Attorney, Agent, or Firm*—Renner, Otto, Boisselle & Sklar

[57] ABSTRACT

A rockable crib including a crib structure and a rocking support system for supporting the crib structure on a floor in a rockable manner. The crib structure includes a resting platform and a plurality of legs coupled to the resting platform. The rocking support system includes a rocking support for each leg of the crib structure. Each rocking support includes a base resting on the floor, a swing pivotally mounted to the base to pivot relative thereto in a substantially horizontal plane, and a crib-support coupling component which couples one of the legs of the crib structure to the swing.

20 Claims, 3 Drawing Sheets

ROCKABLE CRIB AND SUPPORT THEREFOR

FIELD OF THE INVENTION

The present invention relates to a crib which may be rocked relative to the floor in a substantially horizontal plane and to a support therefor.

BACKGROUND OF THE INVENTION

For centuries, infants and young children have slept in crib structures. A crib structure commonly includes a rectangular sleeping platform, and four legs extending from each corner of the platform to support the crib structure on the floor. The legs are sized to position the sleeping platform at a convenient height for attending to the needs of a child within crib. The sleeping platform is typically surrounded by barriers, such as side bars and end panels, to prevent a child from falling off the sleeping platform. The platform, the legs, the barriers, and other components of the crib structure are usually fastened securely together by bolts, screws, nails or glue and intended to be rigidly attached to each other.

Also for centuries, parents have used a rocking motion to comfort and sooth their children, especially at bedtime to facilitate the onset of sleep. For many children, the most calming rocking motion is a linear, "back and forth" motion in a single substantially horizontal plane, with a substantially small stroke, such as 10 inches or less. For example, if a rocking chair is used, a parent will push gently away from the floor with his/her foot whereby the curved rocking support will only be moved relative to the floor at its central section in an abbreviated almost-straight, rocking motion in a primarily horizontal plane.

Another part of the "magic" of rocking is its tapering, rather than abrupt, termination so that a child will not notice the transition to a still state. For example, in a rocking chair, a parent will continue to push gently away from the floor to maintain the desired rocking motion. As a child drifts off to sleep, the parent will stop this pushing, but the chair will continue to rock in a tapering, or dwindling, manner until it reaches a still state.

A child may be rocked to sleep in a rocking chair, and then the sleeping child may be transferred to a crib structure for a hopefully peaceful sleeping session. However, if a child is rocked to sleep while in a crib structure, the chair-to-crib transfer step (and the associated risk of waking up the child) is advantageously eliminated. Rocking a child in a conventional crib can sometimes be crudely accomplished by simply pushing on its upper portion so that it sways relative to its legs. However, while rocking a conventional crib is perhaps possible, it usually not recommended because the forced "swaying" of the intended-to-be rigid crib structure will often cause distortions, stress, weakening or loosing of joints, and other undesirable damage.

In the past, cribs have been constructed with springs or resilient supports to help facilitate rocking the crib. However, the rocking motion of such a crib is non-linear and somewhat sporadic in the vertical direction. Such motion tends to "shake up" or "bounce" the child, rather then to provide the more calming effect of a predictable rocking motion in a substantially horizontal plane.

Additionally or alternatively, if a crib includes castors, a rocking motion can be "faked" by rolling the entire crib back and forth across the floor. However, this rolling requires overcoming the friction of the floor (which may be quite significant if it is carpeted) and may undesirably result in wear and tear on portions of the floor. Also, in an apartment setting, such rolling may be somewhat disturbing to a downstairs neighbor, especially during late night rocking sessions. Still further, while the tapering "magic" of rocking could possibly be roughly imitated when rolling a crib, it requires a great deal of concentration and calculation by a parent (perhaps during a sleepless night) to achieve what comes naturally in a rocking session.

Accordingly, a need remains for a rockable crib which provides a linear rocking motion in a substantially horizontal plane, with a substantially small stroke, in a convenient, controlled, and safe mariner. If this need could be met by incorporating components onto a conventional crib, parents would not have to completely replace an already purchased crib structure to gain the benefits of such a rocking motion.

SUMMARY OF THE INVENTION

The present invention provides a rockable crib comprising a crib structure and a rocking support system for supporting the crib structure on a floor in a rockable manner. The rocking support system includes a rocking support for each leg of the crib structure. Each rocking support includes a base resting on the floor and a swing pivotally mounted to the base to pivot relative thereto in a substantially horizontal plane. A crib-support coupling component may be provided which couples one leg of the crib structure to the swing. The swing preferably pivots relative to the base for a total stroke of less than 15 inches, more preferably less than 10 inches and even more preferably less than 7 inches.

The preferred swing includes a seat to which the crib-support coupling component couples the one leg to the swing, and a pendulum which pivotally mounts the swing to the base. The seat-crib coupling component may include a screw which, if the crib structure originally included castors, could coordinate with the castor-accommodating hole in the crib leg to couple the seat to the crib leg. Alternatively, the seat-crib coupling component could be a cup attached to the seat and having an upper flange forming an open-topped annular channel sized and shaped to receive the distal end of one of the legs. This latter form of the seat-crib coupling component is compatible with a crib structure regardless of whether its legs include castor-accommodating openings.

The preferred pendulum preferably includes a plurality of pendulum arms which are mounted to the base and to the seat in such a manner that they swing the seat in unison relative to the base. More preferably, the pendulum includes four pendulum arms, each of which is coupled to one of the corner portions of the seat. Each of the preferred pendulum arms includes an upper portion rotatably attached to the base and a lower portion fixedly attached to the seat. In one embodiment of the invention, transversely adjacent pendulum arms are integrally joined.

The pendulum arms are designed so that when the crib structure is gently pushed in a longitudinal direction, each of the seats will be swung in unison during the rocking motion in a substantially horizontal plane of a substantially small stroke. Because the entire crib structure moves during the: rocking process, it will not be subject to distortions, stress, weakening of joints, or other undesirable damage that is sometimes caused by the forced swaying of rigid crib structures. Additionally, when the gentle pushing of the crib structure is stopped the crib structure will gradually taper into a still state so that the child will not notice the transition.

As was indicated above, the base of each rocking support rests on the floor and it does not move relative to the floor during the rocking motion. In this manner, the problems sometimes created by rolling cribs (i.e., overcoming the friction of carpeted floors, wear and tear on the floor, disturbance of neighbors, etc.) is eliminated. Preferably, the longitudinal, transverse, and vertical dimensions of the base are substantially less than the longitudinal, transverse, and vertical dimensions, respectively of the crib structure whereby the rockable crib will require only slightly more nursery space than a conventional crib structure.

The crib structure may be a conventional structure including a resting platform and a plurality of legs coupled to the resting platform. Thus, parents do not have to completely replace an already purchased a crib structure to achieve a rockable crib according to the present invention. Accordingly, the present invention also provides a rocking support system for converting a conventional crib structure into a rockable crib.

The invention comprises these and other features hereinafter fully described in the specification and particularly pointed out in the claims. The following description and the annexed drawings set forth in detail certain illustrative embodiments of the invention, these being indicative, however, of but a few of the various ways in which the principles of the invention may be suitably employed.

DETAILED DESCRIPTION OF THE INVENTION

Figure 1:
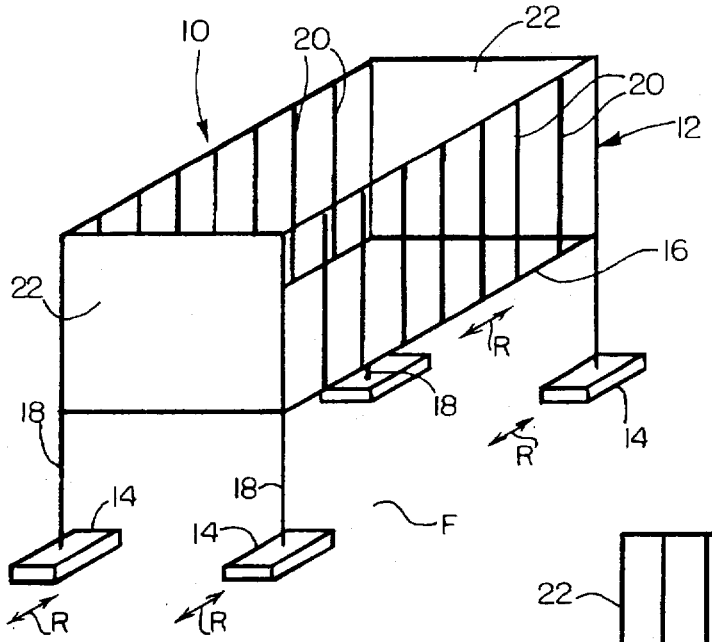
FIG. 1 is a schematic isometric illustration of a rockable crib according to the present invention, the crib including a conventional crib structure and a rocking support system.
Figure 2:
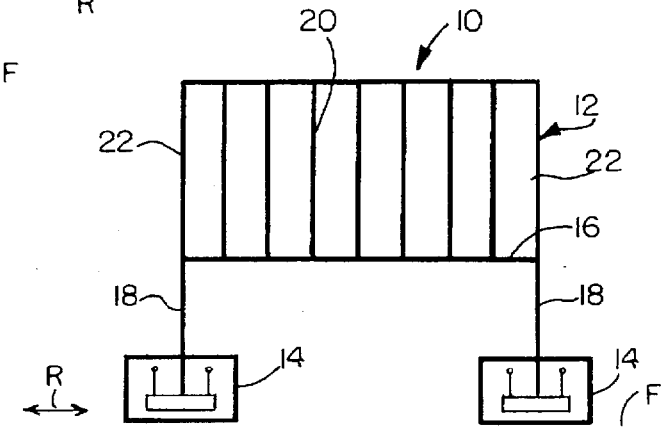
FIG. 2 is a side view of the rockable crib.

A rockable crib 10 according to the present invention is shown in FIGS. 1 and 2. The rockable crib 10 includes a conventional crib structure 12 and a plurality of rocking supports 14 forming a rocking support system for the crib structure 12. As is explained in more detail below, the rocking support system supports the crib structure 12 on the floor F, while at the same time allowing it be moved, or rocked, in a substantially horizontal linear rocking motion R, of a substantially small stroke.

Moreover, the rocking support system may be installed onto a conventional crib structure (such as the illustrated crib structure 12) whereby parents do not have to completely replace an already purchased a crib structure to achieve a rockable crib according to the present invention. Thus, the present invention also provides a rocking support system for converting a conventional crib structure into a rockable crib.

The crib structure 12 includes a rectangular sleeping platform 16, and four supporting legs 18 extending from each corner of the platform. The crib structure 12 also includes side bars 20 and end panels 22 surrounding the platform 16, to prevent a child from falling therefrom. These components of the crib structure 12 are rigid and fastened securely together by bolts, screws, nails or glue. However, the present invention may be used with other types of cribs. In this regard, it should be noted that the term "crib structure" in the context of the present application corresponds to any sleeping or resting surface with or without the barriers. For example, the present invention maybe useful with a small "bar-less" bed for the toddler who is "too big" for the infant crib (or perhaps had to surrender it to a younger sibling) but who still appreciates the pleasures of being rocked to sleep. Moreover, the present invention would probably be welcomed by bedridden children of any age (or adults for that matter) in home and/or hospital settings.

Figure 3:
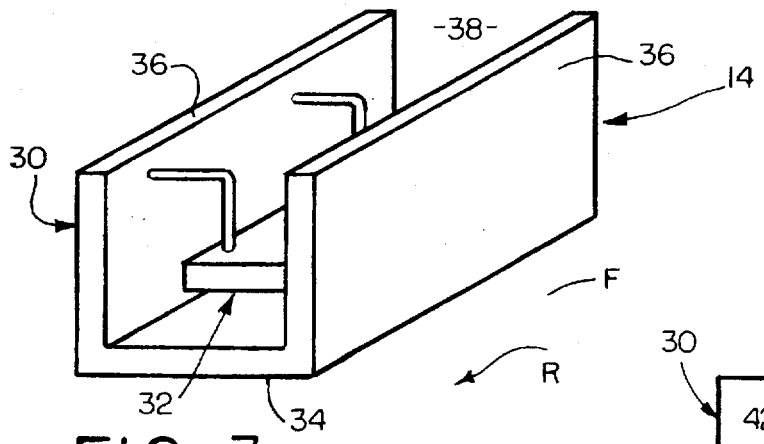
FIG. 3 is an isometric view of one component of the rocking support system, namely one of the four rocking supports.
Figure 4:
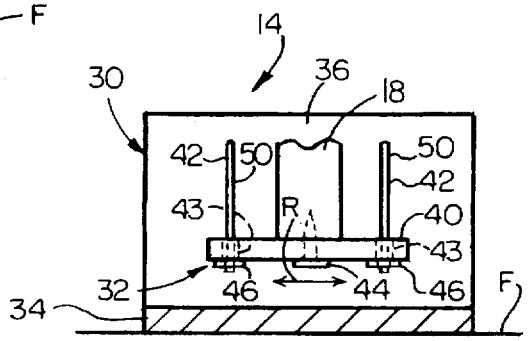
FIG. 4 is a sectional view of the rocking support, the section being taken along its center line parallel with the rocking motion R.
Figure 5:
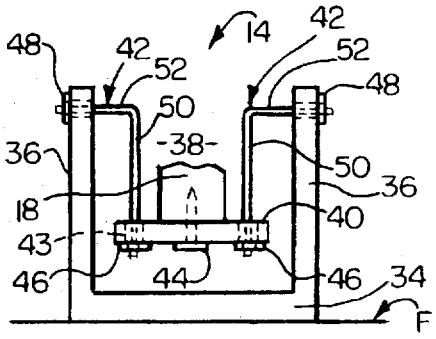
FIG. 5 is an end view of the rocking support.

As was indicated above, the rocking support system of the present invention is formed from four separate rocking supports 14. In FIGS. 3, 4, and 5, one preferred form of the rocking supports 14 is shown isolated from the other components of the rockable crib 10 (except for the distal portion of the crib leg 18). The four rocking supports 14 are preferably essentially the same and interchangeable with each other. Accordingly, the following description of the rocking support 14 applies likewise to the other three supports.

The rocking support 14 includes a base 30 and a swing 32 pivotally (or "rockably") mounted to the base 30. The base 30 includes a bottom wall 34 and two side walls 36, all of which are of generally rectangular shape. The bottom wall 34, and thus the base 30, includes a bottom surface which rests on the floor F and which does not move relative to the floor during the rocking process. The two side walls 36 extend perpendicularly upward from the longitudinal edges of the bottom wall 34. The walls 34 and 36 together form an open-topped and rectangular (in cross-section) channel 38.

While the illustrated and preferred base 30 is a roughly "box" or "brick" shape, otherwise shaped bases are possible with, and contemplated by, the present invention. For example, the base could have a generally trapezoidal shape. However, whatever geometry is used, the base 30 should include a bottom surface which rests of the floor and which does not move relative to the floor during the rocking process.

Also, the base 30 should be dimensioned to provide adequate space for the swing 32 to pivot during the rocking process and preferably shield the swing 32 at the outer points of its pivoting path. To this end, the base 30 preferably has a longitudinal, transverse, and vertical dimensions substantially smaller than the corresponding dimensions of the crib structure 12, preferably less than 25% of the corresponding crib dimensions and more preferably less-than 10% of the corresponding crib dimensions. For example, with a conventional crib structure, the longitudinal dimension of the base 30 would be about 6–15 inches, its transverse dimension would be about 3–7 inches, and its vertical dimension would be about 4–12 inches. Accordingly, the rockable crib 10 will require only slightly more nursery space than a conventional crib structure.

The swing 32 includes a seat 40 and a pendulum which, in the preferred and illustrated embodiment, is comprised of four arms 42. The crib structure 12 is fixedly coupled to the seat 40 by a seat-crib coupling component 44. The seat 40 is fixedly coupled to the pendulum arms 42 by seat-arm coupling components 46. The pendulum arms 42 are pivotally (or "rockably") coupled to the base 30 by arm-base coupling components 48.

The seat 40 is essentially rectangular in shape and the distal end of the crib leg 18 is coupled to the center of the seat 40 by the crib-seat coupling component 44. A suitable crib-seat coupling component would be, as illustrated, a screw extending upwardly through the bottom surface of the seat and into the bottom of the crib leg 18 could be used to produce an integral attachment therebetween. (See FIGS. 4 and 5.) It may noted that if the crib structure 14 originally included castors, the same hole in the bottom of the crib legs 18 used to secure the castors could be used with the crib-coupling component 44.

The swinging motion of the seat 40 is constrained to a substantially horizontal motion by the pendulum supporting the seat. By maintaining such., substantially horizontal motion, the legs of the crib are unlikely to slide off the seat.

Figure 6:
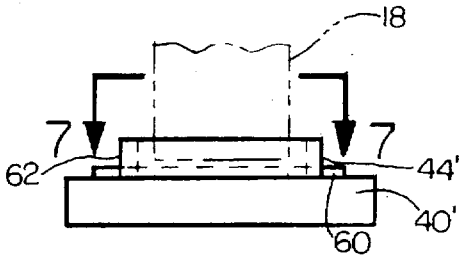
FIG. 6 is a side view of a modified version of a seat-crib coupling component.
Figure 7:
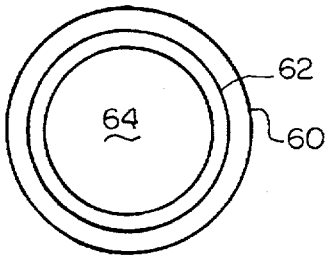
FIG. 7 is a top view of the seat-crib coupling component of FIG. 6.
Figure 12A:
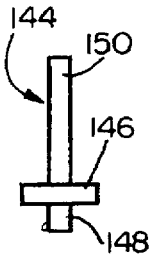
FIG. 12*a*–12*d* are various views of a seat-crib coupling component for use with the rocking support of FIG. 9.

In FIGS. 6 and 7, a modified form 44' of the seat-crib coupling component is shown. The component 44' is a cup-like structure having a lower circular bottom portion 60 attached to the center of the top surface of the seat 40 and an upper flange 62 projecting upward therefrom. The flange 62 forms an open-topped annular channel 64 sized and shaped to receive the distal end of one of the crib legs 18. In this manner, the crib structure 12 can be removably attached to the rocking supports 14 by placing the distal ends of the legs within annular channel 64 of the component 44'. This form of the seat-crib coupling component is compatible with a crib structure regardless of whether its legs include castor-accommodating openings.

In any event, the seats 40 should be designed so that they adequately support the legs and preferably only slightly elevate the crib structure 12 above the floor F. For example, in the illustrated and preferred embodiments, the distal ends of the crib legs 18 will be positioned vertically above the floor about ½ to 2 inches (or 1 to 4 centimeters). Of course, these dimensions are not critical to the invention and larger elevations of the crib structure 12 are possible, and perhaps might be desirable in some situations. However, by keeping this elevation to a minimum when the invention is incorporated into a conventional crib, the sleeping platform 16 will be at a convenient height for attending to the needs of a child within crib structure 12.

Referring now back to FIGS. 1-5, the pendulum arms 42 are of an up-side-down L shape having a lower vertical portion 50 and upper horizontal portion 52. The distal end of the lower vertical portion 50 is attached to one of the corner portions of the seat 40 by one of the seat-arm coupling components 46. The coupling components 46 are preferably selected so that the pendular arms 42 will not rotate, slide, or otherwise move relative to the seat 40. The upper horizontal portion 52 is rotatably attached to the adjacent corner portion of the adjacent side wall 36 of the base 30 by one of the arm-base coupling components 48. The arm-base coupling components 48 are preferably selected so that the pendulum arms 42 can rotate, but not otherwise move, relative to the base 30. For example, the components 48 could incorporate appropriately sized bearings.

The pendulum arms 42 are made of any suitable material, such as metal, plastic, plastic-coated material, etc. While it may be possible to make the arms 42 from a flexible material, such as a non-rigid cord or wire, it is preferred that the arm 42 maintain its shape to properly guide the seat 32 within the base's channel 38. In this regard, it is noted that the seat 40 and the pendulum arms 42 are sized to avoid the seat contacting the walls 34 and 36 of the base 30 during the rocking process.

Figure 8:
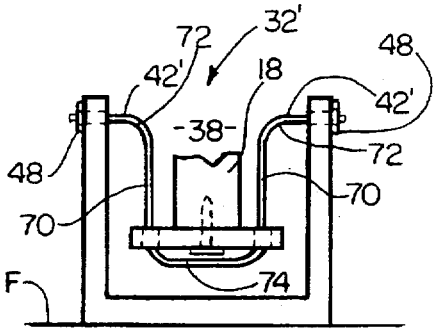
FIG. 8 is an end view of a modified version of the rocking support.

In FIG. 8, a modified form of the swing's pendulum is shown. In this pendulum, transversely adjacent arms 42' are integrally joined. As with the pendulum arms 42, each of the arms 42' includes a lower vertical portion 70 and an upper horizontal portion 72, except that these portions are joined by a curved, rather than angular, corner. The distal ends of the upper horizontal portion 72, like the corresponding portion 52 in the pendulum arm 42, is rotatably attached to the adjacent corner portion of the adjacent side wall 36 of the base 30 by one of the arm-base coupling components 48. However, the distal ends of the lower vertical portion 70 extend through an opening in seat 40 and a bottom connecting portion 74 joins the lower vertical portions 70 of transversely adjacent pendulum arms 42' together beneath the seat 40. When the pendulum arms 42' are used, arm-base coupling components are not necessary.

Figure 10:
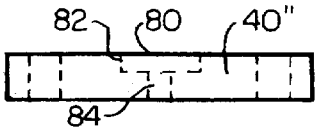
FIG. 10 is an end view of the seat of the rocking support shown in FIG. 9.
Figure 12B:
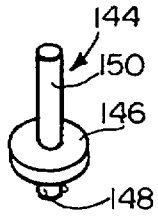
Figure 9:
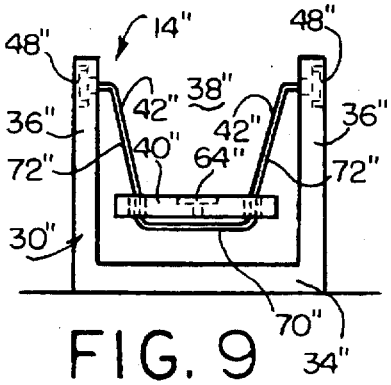
FIG. 9 is an end view of another modified version of the rocking support, without the seat-crib coupling component.
Figure 11:
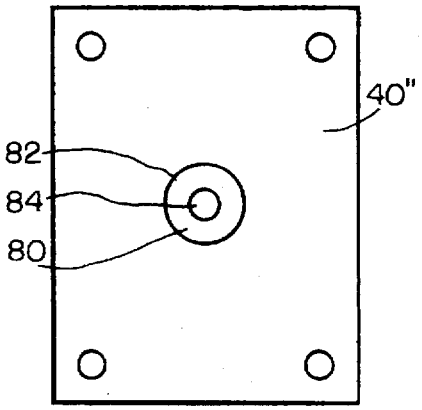
FIG. 11 is a top view of the seat of FIG. 10.
Figure 12C:
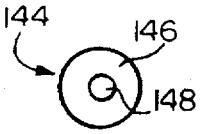
Figure 12D:
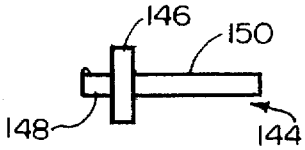
Figure 13A:
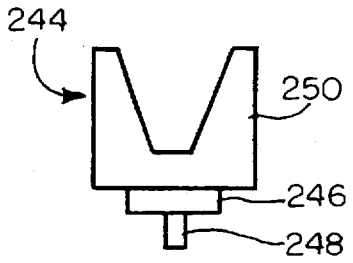
FIG. 13*a*–13*d* are various views of another seat-crib coupling component for use with the rocking support of FIG. 9.
Figure 13B:
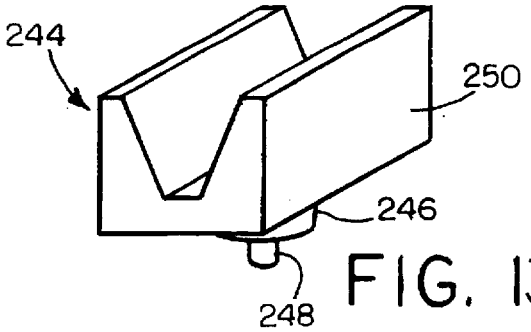
Figure 13C:
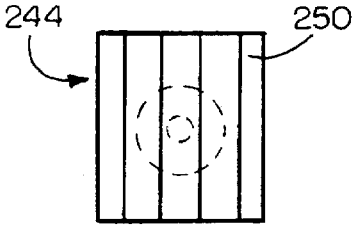
Figure 13D:
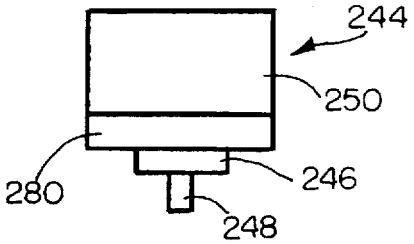

In FIG. 9, a modified version 14" of the rocking support is shown. This support 14" is similar in many ways to those supports discussed above whereby like reference numerals (with a double prime) are used to designate like parts. However, in the support 14", the side walls 36" of the base 30" include recesses to accommodate the arm-base coupling components 48". Also, the seat 40" includes a central opening 80 comprising an upper circular section 82 and a lower circular section 84 of substantially less diameter. (See also, FIGS. 10 and 11.) This opening 80 accommodates a seat-crib coupling component, such as those shown in FIGS. 12 and 13.

In FIG. 12, the seat-crib coupling component 144 includes a wide circular portion 146, a lower narrow cylindrical portion 148, and an upper narrow cylindrical portion 150 (which may or may not be of the same diameter: as the portion 148). When used with the rocking support 14", the wide circular portion 146 fits within the upper circular section 82 of the seat's central opening 80 and the lower portion 148 fists within the lower circular section 84 of the opening 80. The component 144 may be locked in place within the opening 80 by appropriate locking structure (not shown). The upper portion 140 of the coupling component projects upward from the seat 40" for insertion into the bottom of the crib leg 18 to produce an integral attachment therebetween. Again, if the crib structure 14 originally included castors, the same hole in the bottom of the crib legs 18 used to secure the castors could be used with the crib-coupling component 144.

In FIG. 13, the seat-crib coupling component 244 includes a wide circular portion 246, a lower narrow cylindrical portion 248, and upper trough-shaped portion 250. The portions 246 and 248 fit within the seat's opening 80 in much the same manner as the portions 146 and 148 of the seat-crib coupling component 144. The trough-shaped portion 250 is sized to receive the distal end of one of the crib legs 18. In this manner, the crib structure can be removably attached to the rocking supports by placing the distal ends of the legs within the triangular channel formed by the portion 250. This form of the seat-crib coupling component is compatible with a crib structure regardless of whether its legs include castor-accommodating openings.

In any event, the pendulum arms are designed so that when the crib structure 12 is gently pushed in a longitudinal direction (such as by pressing on one of end panels 22), each of the four seats of the four rocking supports will be swung in unison during the rocking motion in a substantially horizontal plane of a substantially small stroke. Because the entire crib structure 12 moves during the rocking process, it will not be subject to distortions, stress, weakening of joints, or other undesirable damage that is sometimes caused by the forced swaying of rigid crib structures. Additionally, when the gentle pushing of the crib structure 12 is stopped (i.e., the child has drifted into dreamland), the crib structure 12 will taper into a still state so that the child will not notice the transition. Additionally, since the base 30 does not move relative to the floor F, the problems sometimes created by rolling cribs (i.e., overcoming the friction of carpeted floors, wear and tear on the floor, disturbance of neighbors) is eliminated. Moreover, the size of the rocking supports is preferably such that the rockable crib will not occupy substantially more nursery space than a conventional crib structure.

Although the invention is illustrated and described with respect to rocking system for a crib or a rockable crib itself, it will be appreciated that the invention may be used to provide such rocking function for other devices, such as chairs, hammocks, etc. Also, although the invention is illustrated using four supports for the respective legs of a crib, it will be appreciated that the invention may be used with more or less than four supports and for cribs or other devices with more or fewer than four legs.

Although the invention has been shown and described with respect to certain preferred embodiments, it is obvious that equivalent alternations and modifications will occur to others skilled in the art upon the reading and understanding of this specification. The present invention includes all such equivalent alterations and modifications and is limited only by the scope of the following claims.

What is claimed is:

1. A rockable crib comprising a crib structure and a rocking support system for supporting the crib structure on a floor in a rockable manner, wherein:

the crib structure includes a resting platform and a plurality of supporting legs coupled to the resting platform;

the rocking support system includes a rocking support for each supporting leg of the crib structure;

each rocking support includes a base resting on the floor and a swing pivotally mounted to the base to pivot relative thereto in a substantially horizontal plane.

2. A rockable crib as set forth in claim 1 further comprising a crib-support coupling component which couples one of the legs of the crib structure to the swing.

3. A rockable crib as set forth in claim 2 wherein the swing includes a seat to which the crib-support coupling component couples the one leg to the swing, and a pendulum which pivotally mounts the swing to the base.

4. A rockable crib as set forth in claim 3 wherein the pendulum includes a plurality of pendulum arms which are mounted to the base and to the seat in such a manner that they swing the seat in unison relative to the base.

5. A rockable crib as set forth in claim 4 wherein the seat includes four corner portions and the pendulum includes four pendulum arms, each of the pendulum arms being coupled to one of the corner portions of the seat.

6. A rockable crib as set forth in claim 4 wherein each of the pendulum arms includes an upper portion rotatably attached to the base and a lower portion fixedly attached to the seat.

7. A rockable crib as set forth in claim 6 wherein transversely adjacent pendulum arms are integrally joined.

8. A rockable crib as set forth in claim 3 wherein the crib-support coupling component of each of the rocking supports is a screw.

9. A rockable crib as set forth in claim 3 wherein the crib-support coupling component of each of the rocking supports is a cup attached to the seat and having an upper flange forming an open-topped annular channel sized and shaped to receive the distal end of one of the legs.

10. A rockable crib as set forth in claim 1, wherein the longitudinal, transverse, and vertical dimensions of the base are substantially less than the longitudinal, transverse, and vertical dimensions, respectively of the crib structure.

11. A rockable crib as set forth in claim 10 wherein the longitudinal, transverse, and vertical dimensions of the base are less than 25% of the longitudinal, transverse, and vertical dimensions, respectively of the crib structure.

12. A rockable crib as set forth in claim 11 wherein the longitudinal, transverse, and vertical dimensions of the base are less than 10% of the longitudinal, transverse, and vertical dimensions, respectively of the crib structure.

13. A rockable crib as set forth in claim 11 wherein the swing pivots relative to the base for a total stroke of less than 15 inches.

14. A rockable crib as set forth in claim 13 wherein the swing pivots relative to the base for a total stroke of less than 10 inches.

15. A rockable crib as set forth in claim 14 wherein the swing pivots relative to the base for a total stroke of less than 7 inches.

16. A rockable crib as set forth in claim 1 wherein the swing pivots relative to the base for a total stroke of less than 15 inches.

17. A rockable crib as set forth in claim 16 wherein the swing pivots relative to the base for a total stroke of less than 10 inches.

18. A rockable crib as set forth in claim 17 wherein the swing pivots relative to the base for a total stroke of less than 5 inches.

19. A rockable crib as set forth in claim 1 wherein each of the rocking supports is essentially identical and interchangeable.

20. A rocking support system for converting a conventional crib structure, having a sleeping platform and four legs extending downward from the four corners of the sleeping platform, into a rockable crib, said rocking support system comprising four rocking supports, each support including:

a base for resting on the floor, a swing pivotally mounted to the base to pivot relative thereto in a substantially horizontal plane, a crib-support coupling component which couples one of the legs of the crib structure to the swing.

* * * * *